US010494224B2

(12) United States Patent
Prakash

(10) Patent No.: US 10,494,224 B2
(45) Date of Patent: Dec. 3, 2019

(54) STAGGERED BRAKING OF AN ELEVATOR

(71) Applicant: Inventio AG, Hergiswil (CH)

(72) Inventor: Om Prakash, Viman Nagar Pune (IN)

(73) Assignee: INVENTIO AG, Hergiswil NW (CH)

( * ) Notice: Subject to any disclaimer, the term of this patent is extended or adjusted under 35 U.S.C. 154(b) by 9 days.

(21) Appl. No.: 15/770,309

(22) PCT Filed: Oct. 31, 2016

(86) PCT No.: PCT/EP2016/076201
§ 371 (c)(1),
(2) Date: Apr. 23, 2018

(87) PCT Pub. No.: WO2017/076793
PCT Pub. Date: May 11, 2017

(65) Prior Publication Data

US 2018/0319623 A1 Nov. 8, 2018

(30) Foreign Application Priority Data

Nov. 2, 2015 (EP) ..... 15192612

(51) Int. Cl.
*B66B 1/32* (2006.01)
*B66B 5/18* (2006.01)

(52) U.S. Cl.
CPC . *B66B 1/32* (2013.01); *B66B 5/18* (2013.01)

(58) Field of Classification Search
CPC ..... B66B 1/32; B55B 5/18
USPC ..... 318/372
See application file for complete search history.

(56) References Cited

U.S. PATENT DOCUMENTS 4,664,247 A 5/1987 Wolf et al.
6,269,910 B1 8/2001 Fargo et al.
6,865,049 B1 * 3/2005 Codilian ..... G11B 19/00 318/376
7,408,791 B2 * 8/2008 Virolainen ..... H02P 3/22 318/375

(Continued)

FOREIGN PATENT DOCUMENTS

CN 101163634 A 4/2008
CN 100404404 C 7/2008

(Continued)

OTHER PUBLICATIONS

Time switch, Sep. 1, 2017, https://en.wikipedia.org/wiki/Time_switch, all pages.

*Primary Examiner* — Kawing Chan
(74) *Attorney, Agent, or Firm* — William J. Clemens; Shumaker, Loop & Kendrick, LLP

(57) ABSTRACT

A apparatus and method for operating an electromagnetic elevator brake during a mains power disruption or emergency stop includes the steps of providing an uninterruptible power supply in a power circuit arranged in parallel to a brake coil and repeatedly opening and closing the power circuit during the mains power disruption or emergency stop. In comparison to the conventional braking during power disruption, the periodic or staggered braking provided by repeatedly opening and closing the power circuit greatly extends the time taken to bring the elevator to a halt. Accordingly, passengers will feel less discomfort when the elevator is braked automatically during power disruption.

15 Claims, 5 Drawing Sheets

(56) References Cited

U.S. PATENT DOCUMENTS

| | | | | |
|---|---|---|---|---|
| 2004/0075408 | A1* | 4/2004 | Gorti | H02P 3/12 318/381 |
| 2004/0118638 | A1* | 6/2004 | Delaporte | B60P 1/4471 187/224 |
| 2008/0202859 | A1* | 8/2008 | Tegtmeier | B66B 1/30 187/290 |
| 2009/0229924 | A1 | 9/2009 | Kondo et al. | |
| 2009/0251081 | A1* | 10/2009 | Thunes | H02P 3/12 318/375 |
| 2011/0203877 | A1* | 8/2011 | Tiner | B66B 5/027 187/247 |
| 2012/0118675 | A1 | 5/2012 | Abad | |
| 2017/0313548 | A1* | 11/2017 | Nakari | B66B 1/32 |
| 2018/0229969 | A1* | 8/2018 | Bhosale | B66B 1/32 |

FOREIGN PATENT DOCUMENTS

| | | | |
|---|---|---|---|
| CN | 101522553 | A | 9/2009 |
| CN | 103201205 | A | 7/2013 |
| CN | 103328362 | A | 9/2013 |
| CN | 104555626 | A | 4/2015 |
| EP | 2058261 | A1 | 5/2009 |

* cited by examiner

Cyclic timer T
1
0

OFF delay K1
1
0

Elevator speed
(m/s)
1.75
0

0
100
200
300
400
500
time (ms)

STAGGERED BRAKING OF AN ELEVATOR

FIELD

The present invention relates to elevators and, more particularly, to an apparatus and method for braking elevators particularly during power disruption or upon activation of an emergency stop.

BACKGROUND

A conventional traction elevator typically comprises a car, a counterweight and traction means such as a rope, cable or belt interconnecting the car and the counterweight. The traction means passes around and engages with a traction sheave which is driven by a motor. The motor and the traction sheave rotate concurrently to drive the traction means, and thereby the interconnected car and counterweight, along an elevator hoistway. At least one brake is employed in association with the motor or the traction sheave to stop the elevator and to keep the elevator stationary within the hoistway. A controller supervises movement of the elevator in response to travel requests or calls input by passengers.

The brakes must satisfy strict regulations. For example, both European Standard EN 81-1:1998 and the ASME A17.1-2000 code in the United States state that the elevator brake must be capable of stopping the motor when the elevator car is travelling downward at rated speed and with the rated load plus 25%.

Furthermore, the elevator brake is typically installed in two sets so that if one of the brake sets is in anyway faulty, the other brake set still develops sufficient braking force to slow down an elevator car travelling at rated speed and with rated load.

Conventionally, the elevator brakes engage with a rotating component of the motor such as a brake drum or brake discs mounted for concurrent rotation of the motor shaft. Each brake normally has a brake pad that is spring biased towards the surface of the brake drum or disc. Additionally, an electromagnet may be arranged within the brake so that when the coil of the electromagnet is energized it exerts a force on the brake pad to counteract the spring bias and release or disengage the brake pad from the brake drum or disc.

Accordingly, the brake is released or disengaged by supplying electricity to the brake coil through a power supply circuit. Conversely, the brake is engaged by disconnecting the power supply circuit from the brake coil for example with a relay or contactor arranged within the circuit.

Due to the strict safety regulations summarized above, the force exerted by a brake on the drum or disc is substantial, so that when a complete power failure or a disruption such as under-voltage occurs with the commercial mains power supply, the brake pad immediately engages to brake the movement of the elevator car with a large force. The same effect will also be produced if a passenger within the elevator car presses the emergency stop button located normally on the car operation panel.

Typically, the force developed by the brake will be sufficiently large so as to bring an elevator car travelling at 1 m/s to a full halt within 200 ms. This sharp reduction in speed will be uncomfortable and unsettling to any passenger riding in the elevator car and, in some cases, might even lead to injury of the travelling passenger. This problem is understandably further exaggerated in countries throughout the world which experience frequent power disruptions.

SUMMARY

An objective of the present invention is to solve the aforementioned drawbacks by providing an apparatus and method for braking elevators.

The present invention provides an apparatus for operating an electromagnetic elevator brake comprising a power circuit configured for arrangement in parallel to a brake coil, the power circuit having an uninterruptible power supply and a power contact to open and close the power circuit, and a control circuit having a serial branch comprising a cyclic timer and a detection contact arranged across a second uninterruptible power supply, wherein the cyclic timer, upon energization, repeatedly opens and closes the power contact in the power circuit.

Rather than fully engaging the elevator brake, the cyclic timer which opens and closes the power contact in the power circuit provides the effect of intermittent or staggered braking whereby the brake is applied and released repeatedly resulting in a smoother stopping sequence.

In comparison to the conventional braking during power disruption or an emergency stop as discussed above, the periodic or staggered braking provided by the present apparatus greatly extends the time taken to bring the elevator to a halt. Accordingly, passengers will feel less discomfort when the elevator is braked automatically during power disruption or an emergency stop.

Typically, the detection contact is responsive to disruption of mains power. Alternatively, the detection contact may be responsive to the pressing an emergency stop button within an elevator car. In either case, the detection contact selectively closes the serial branch of the control circuit to energize the cyclical timer.

Preferably, the apparatus further comprises a second detection contact arranged in parallel across the first detection contact. With this arrangement the first detection contact can be configured for response to disruption of mains power and the second detection contact responsive to the pressing of an emergency stop button. Accordingly, the apparatus can provide staggered braking in both situations.

Typically, the cyclical timer, upon energization, pulses on and off at least every 50 ms and, more preferably, at least every 20 ms. If applied to a conventional arrangement as described above where the fully applied brake force is sufficient to bring an elevator car travelling at 1 m/s to a full halt within 200 ms, it will be appreciated that an apparatus according to the invention will ensure that the brake is applied and released multiple times before the elevator car is finally brought to a halt thereby smoothing the braking operation.

Preferably, the control circuit further comprises at least one delay timer relay arranged in parallel across the cyclical timer. Therefore when the cyclical timer is energized, the delay timer relay is likewise energized. The delay timer relay inherently functions with a preset or predetermined delay interval. This delay interval can be used to effectively limit the duration for which the cyclical timer is energized and operating.

For example, the delay timer relay may be used to operate a delay contact in the serial branch of the control circuit. In this case, the relay could open its contact after the delay interval to open the serial branch and thereby de-energize the cyclical timer. Preferably, the predetermined delay interval which for a particular elevator installation could be set to equate to the duration expected for the brake to bring the elevator car to a full halt. This of course would depend on the rated load and rated speed of the specific elevator.

The delay timer relay may be implemented as an ON delay timer with the associated delay contact being a normally closed contact.

Preferably, a detection relay is used to detect disruption of mains power and to operate the detection contact. In such an arrangement, redundancy can be introduced by providing a second serial branch arranged across the second uninterruptible power supply comprising a further delay timer relay and a further detection contact operable by the detection rely. Typically, the detection contact in the first serial branch is a normally closed contact and the further detection contact in the second serial branch is a normally open contact.

Accordingly, on detection of a power disruption, the detection rely drops whereby the detection contact in the first branch closes to power the cyclical timer. At the same time the further detection contact in the second serial branch opens and triggers the further delay timer relay which is implemented as an OFF delay relay. After the predetermined delay interval, the OFF delay relay will open its contact on the first serial branch thereby de-energizing the cyclical timer. Not only is redundancy provided through the use of the two serial circuit branches, but a safety interlock is provided through the utilization of the delay timer relay arranged in parallel across the cyclical timer on the first branch and the further delay timer relay in the second branch. If one of the delay timer relays were to fail, the then other could ensure that the first branch is opened and the cyclical timer is de-energized after its preset delay interval.

The use of one or more delay timer relays ensures that the cyclical timer operates only when needed to brake elevator for a predefined interval rather than for the entire duration of the power disruption which could in certain instances be several hours. This effectively limits the power capacity required of and the power drawn from the first uninterruptible power supply during disruption of commercial mains power.

Preferably, the power supply circuit additionally contains a drive contact serially arranged with the power contact and the brake coil between the positive and negative terminals of the first uninterruptible power supply. This ensures that the control circuit is completely isolated from the electromagnetic brake during normal operation when mains power supply is available. Furthermore, the drive contact can be configured to be closed only whenever the elevator is travelling. Accordingly, the first uninterruptible power supply only needs to supply energy to the brake coil when the elevator is travelling upon commencement of the disruption to the commercial power supply. On the contrary if the elevator is already stationary upon commencement of mains power supply disruption, then there is no need for further braking and the open drive contact will prevent energy to flow from the first uninterruptible power supply to the brake coil. Therefore, the drive contact ensures that apparatus only provides pulsed braking of the elevator if the elevator is already travelling upon the onset of the disruption to the mains power supply.

The primary reason for two uninterruptible power supplies is that the voltage of the logic signals required by the control circuit will be significantly less than the voltage required to drive energization current through the brake coil. However, it will be appreciated that a single uninterruptible power supply can be implemented instead with the necessary DC/DC convertor(s) to feed both the power circuit and the control circuit of the brake controller, respectively.

The or each uninterruptible power supply can be a simple battery arrangement with or without battery charging capability from the mains power supply. Alternatively, it may be any suitable electrical storage system that can continue to supply electricity during a mains power disruption for a small amount of time. For example, it could be a simple capacitor bank capable of supplying brief intermittent power for the small duration required to bring the elevator to a complete stop.

Preferably, the control circuit is implemented in software.

The invention also provides a method of operating an electromagnetic elevator brake comprising the steps of providing an uninterruptible power supply in a power circuit arranged in parallel to a brake coil, determining whether there is a disruption to a commercial mains power supply or whether an emergency button has been activated in an elevator car, and repeatedly opening and closing the power circuit.

Rather than fully engaging the elevator brake, the opening and closing of the power circuit provides the effect of intermittent or staggered braking whereby the brake is applied and released repeatedly resulting in a smoother stopping sequence.

In comparison to the conventional braking during power disruption or an emergency stop as discussed above, the periodic or staggered braking provided by the present method upon commencement of the power disruption or emergency stop greatly extends the time taken to bring the elevator to a halt. Accordingly, passengers will feel less discomfort when the elevator is braked automatically during power disruption or an emergency stop.

Preferably, the method further comprises the step of determining whether an elevator is travelling. Naturally, if the elevator is already stationary then there is no need for further braking.

Furthermore, the step of repeatedly opening and closing the power circuit can be implemented for a preset interval only. Preferably, the predetermined delay interval could be set to equate to the duration expected for the brake to bring the elevator to a full halt. This of course would depend on the rated load and rated speed of the specific elevator. Accordingly, staggered or intermittent braking is effected by the method only for a predefined interval rather than for the entire duration of the power disruption which could in certain instances be several hours. This effectively limits the power capacity required of and the power drawn from the uninterruptible power supply during disruption of commercial mains power.

The method can be terminated by opening the power circuit in which case full braking force is applied as in the conventional installations.

Typically, the power circuit is opened and closed at least every 50 ms and, more preferably, at least every 20 ms to ensure that the brake is applied and released multiple times before the elevator car is finally brought to a halt.

DESCRIPTION OF THE DRAWINGS

The novel features and method steps characteristic of the invention are set out below. The invention itself, as well as other features and advantages thereof, are best understood by reference to the detailed description, which follows, when read in conjunction with the accompanying drawings, wherein.

DETAILED DESCRIPTION

Figure 1:
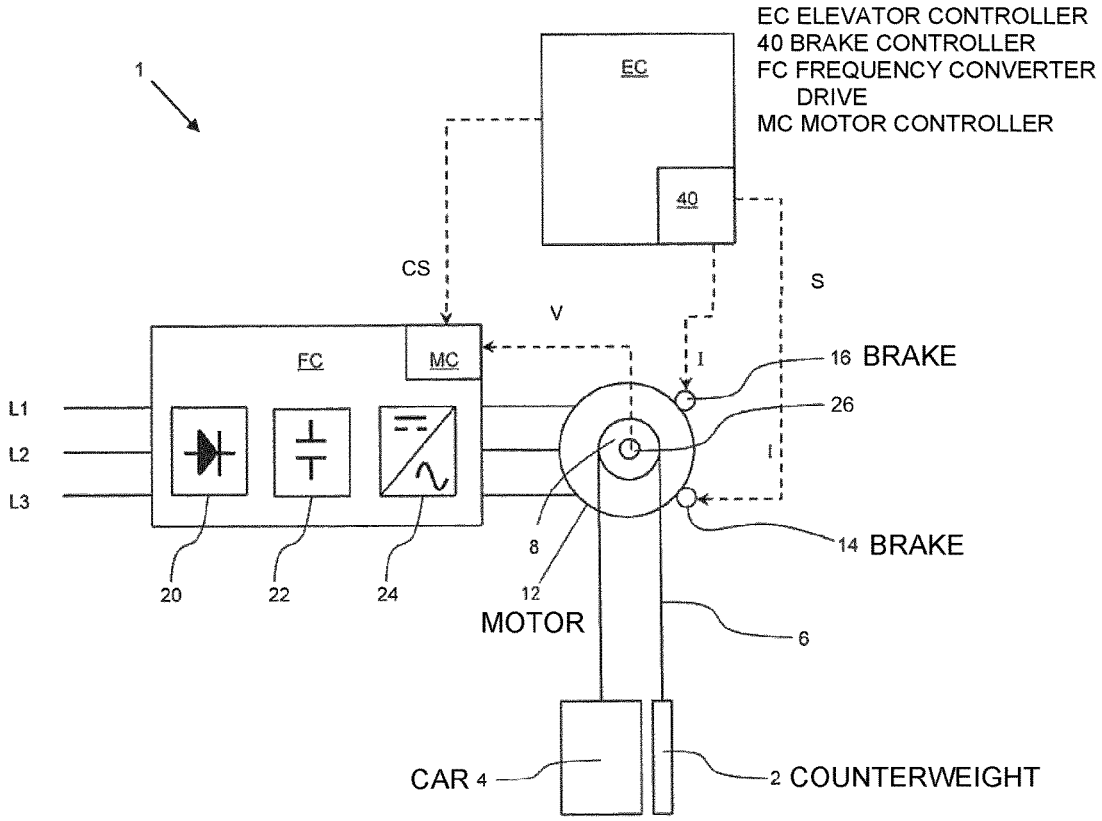
FIG. 1 is a schematic illustration of a typical elevator installation including a brake controller according to the invention.

A conventional elevator installation 1 for use with the method and apparatus according to the invention is shown in FIG. 1. The installation 1 is generally defined by a hoistway bound by walls within a building wherein a counterweight 2 and car 4 are movable in opposing directions along guide rails. Suitable traction means 6, such as a rope or belt, supports and interconnects the counterweight 2 and the car 4. In the present embodiment the weight of the counterweight 2 is equal to the weight of the car 4 plus 40% of the rated load which can be accommodated within the car 4. The traction means 6 is fastened at one end to the counterweight 2, passed over a traction sheave 8 located in the upper region of the hoistway and fastened to the elevator car 4 at the other end. Naturally, the skilled person will easily appreciate other roping arrangements are equally possible and that the counterweight balancing factor can be changed as required to meet particular specifications.

The traction sheave 8 is driven via a drive shaft by a motor 12 and braked by at least one elevator brake 14,16. The use of at least two brake sets is compulsory in most jurisdictions (see, for example, European Standard EN81-1:1998 12.4.2.1). Accordingly, the present example utilizes two independent, electro-mechanical brakes 14 and 16 to engage with a disc mounted to the drive shaft of the motor 12. As an alternative to the brake discs, the brakes could be arranged to act on a brake drum mounted for concurrent rotation with the drive shaft of the motor 14 as in WO-A2-2007/094777. The structure and operation of the brakes 14,16 will be described in more detail in the description below of FIGS. 2-6.

Conventionally, power from the commercial mains AC power supply is fed in three phases L1, L2 and L3 via a frequency converter drive FC to the motor 12. The drive FC includes a diode-bridge rectifier 20 which converts AC line voltage into DC voltage on a DC link 22 which would typically include a capacitor to smooth any ripple in the DC voltage output from the rectifier 20. The filtered DC voltage of the DC link 22 is then input to an inverter 24 and converted into AC voltages for the motor 12 by selective operation of a plurality of solid-state switching devices within the inverter 24, such as ICGTs, which are controlled by PWM signals output from a motor controller MC incorporated in the drive FC.

Overall operation of the elevator 1 is controlled and regulated by an elevator controller EC. The elevator controller EC receives calls placed by passengers on operating panels located on the landings of the building and, optionally, on a panel mounted within the elevator car 4. It will determine the desired elevator trip requirements and, before commencement of the trip, will instruct a brake controller 40 to output a current signal I so as to release the brakes 14,16, and additionally issue a travel command signal CS to the motor controller MC which energizes and controls the inverter 24 to allow the motor 12 to transport the passengers with the car 4 to the desired destination within the building. Movement of the motor 12, and thereby the elevator car 4, is continually monitored by an encoder 26 mounted on the traction sheave 8 or on the motor shaft. A signal V from the encoder 26 is fed back to the motor control MC permitting it to determine travel parameters of the car 4 such as position, speed and acceleration.

Although the brake controller 40 is shown in FIG. 1 as being incorporated in the elevator controller EC, it will be readily appreciated that the brake controller 40 can be housed external to the elevator controller EC or even contained within the drive FC as is the case for the motor controller MC of the embodiment depicted in FIG. 1.

Figure 2:
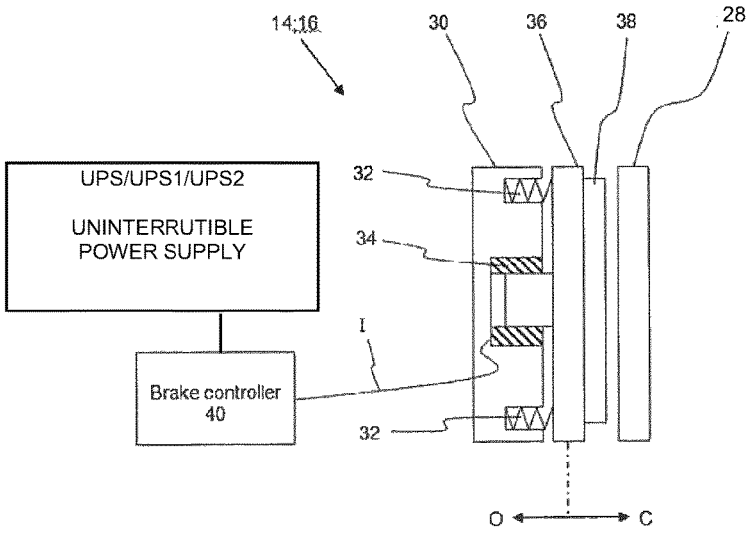
FIG. 2 is a schematic illustrating the main components of the electro-mechanical brakes of FIG. 1.

FIG. 2 is a schematic illustrating the main components of the electro-mechanical brakes 14 and 16 of FIG. 1. Each brake 14;16 is connected by suitable cabling to a brake controller 40 and includes an actuator 30 and an armature 36 to which a brake lining 38 is mounted.

The actuator 30 houses one or more compression springs 32 which are arranged to bias the armature 36 in brake closing direction C towards a brake disc 28 mounted on a drive shaft of the motor 12. Additionally, a brake coil 34 is arranged within the actuator 30. The coil 34, when supplied by current I from the brake controller 40, exerts an electromagnetic force on the armature 36 in the brake opening direction θ to counteract the biasing force of the springs 32 and move the armature 36 away from the brake disc 28.

The brake controller 40 will further be explained with reference to FIG. 3 which illustrates a control circuit 60 and a power circuit 50, respectively, both of which are housed within the brake controller 40.

Figure 3:
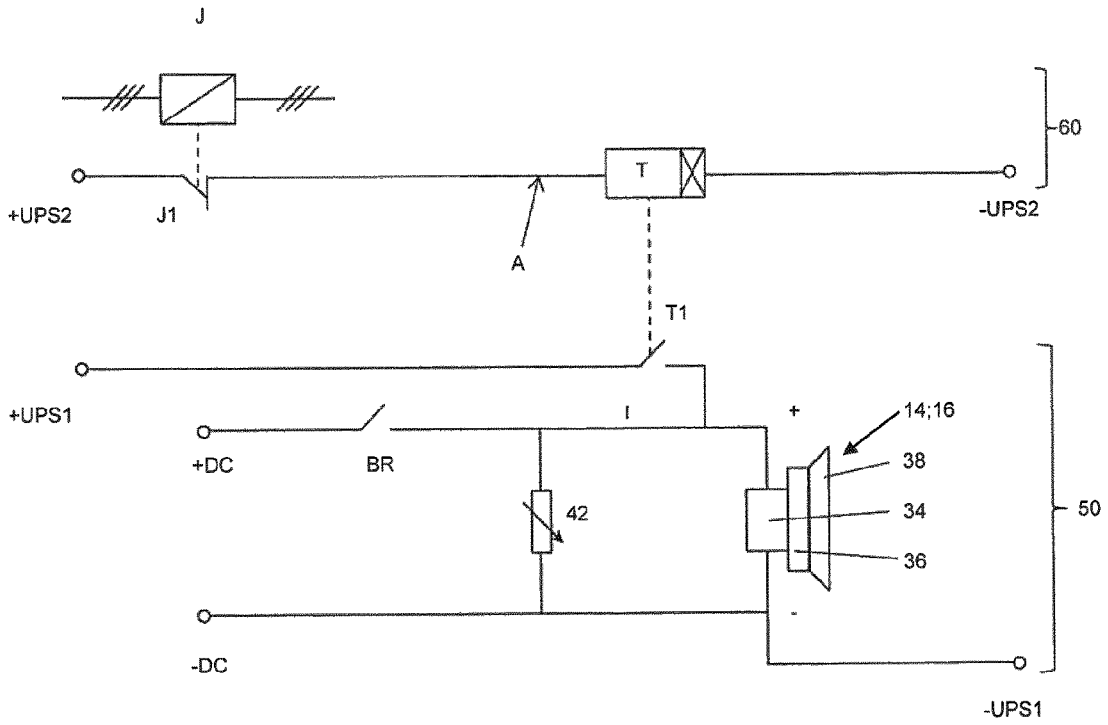
FIG. 3 is a topography of a brake control circuit and a power circuit for use in the brake controller of FIGS. 1 and 2.

In normal operation of the elevator 1, when sufficient mains power supply is available, DC power derived from the mains power supply, can be selectively supplied to the coil 34 through the brake contactor or relay BR as shown in the power supply circuit 50 towards the bottom portion of FIG. 3. Accordingly, in normal operation, the brake 14;16 will be released by closing the brake relay BR such that current I flows from the positive terminal +DC through the coil 34 to the negative terminal −DC of the power supply circuit 50. Conversely, when the brake relay BR is opened, the brake coil 34 is simultaneously disconnected from the power supply circuit 50 and the compression springs 32 will move the armature 36 in the direction C so that the brake lining 38 engages and thereby brakes the brake disc 28. An adjustable resistor 42 is provided in parallel across the brake coil 34 to permit adjustment during maintenance or commissioning operations.

The power supply circuit 50 additionally contains a further circuit arranged in parallel with the brake coil 34. This further circuit, which is used primarily during mains power disruption, includes the positive terminal +UPS1 of a first uninterruptible power supply UPS1, serially arranged with a cyclical timer power contact T1, the coil 34 and the negative terminal −UPS1. In normal operation outlined above, when sufficient mains power supply is available, the cyclical timer contact T1 remains open.

Control of the power circuit 50 during mains power disruption is implemented by the control circuit 60 shown in the upper portion of FIG. 3. The control circuit 60 is powered by a further, second uninterruptible power supply UPS2. The primary reason for two uninterruptible power supplies is that the voltage of the logic signals required by the control circuit 50 will be significantly less than the voltage required to drive the energization current I through the brake coil 34. However, it will be appreciated that a single uninterruptible power supply UPS can be implemented instead with the necessary DC/DC convertor(s) to feed both the power circuit 50 and the control circuit 60, respectively.

In this first embodiment, the control circuit 60 is in its most elemental form and has a circuit branch A comprising a serial arrangement of a normally closed (NC) detection contact J1 and a cyclical timer T arranged between the positive and negative terminals of the second uninterruptible power supply UPS2.

On power failure, a detection relay J within the control circuit 60 de-energizes causing its detection contact J1 to close. Accordingly, power can now flow through the circuit branch A thereby energizing the cyclical timer T.

Figures 5A, 5B, 5C:
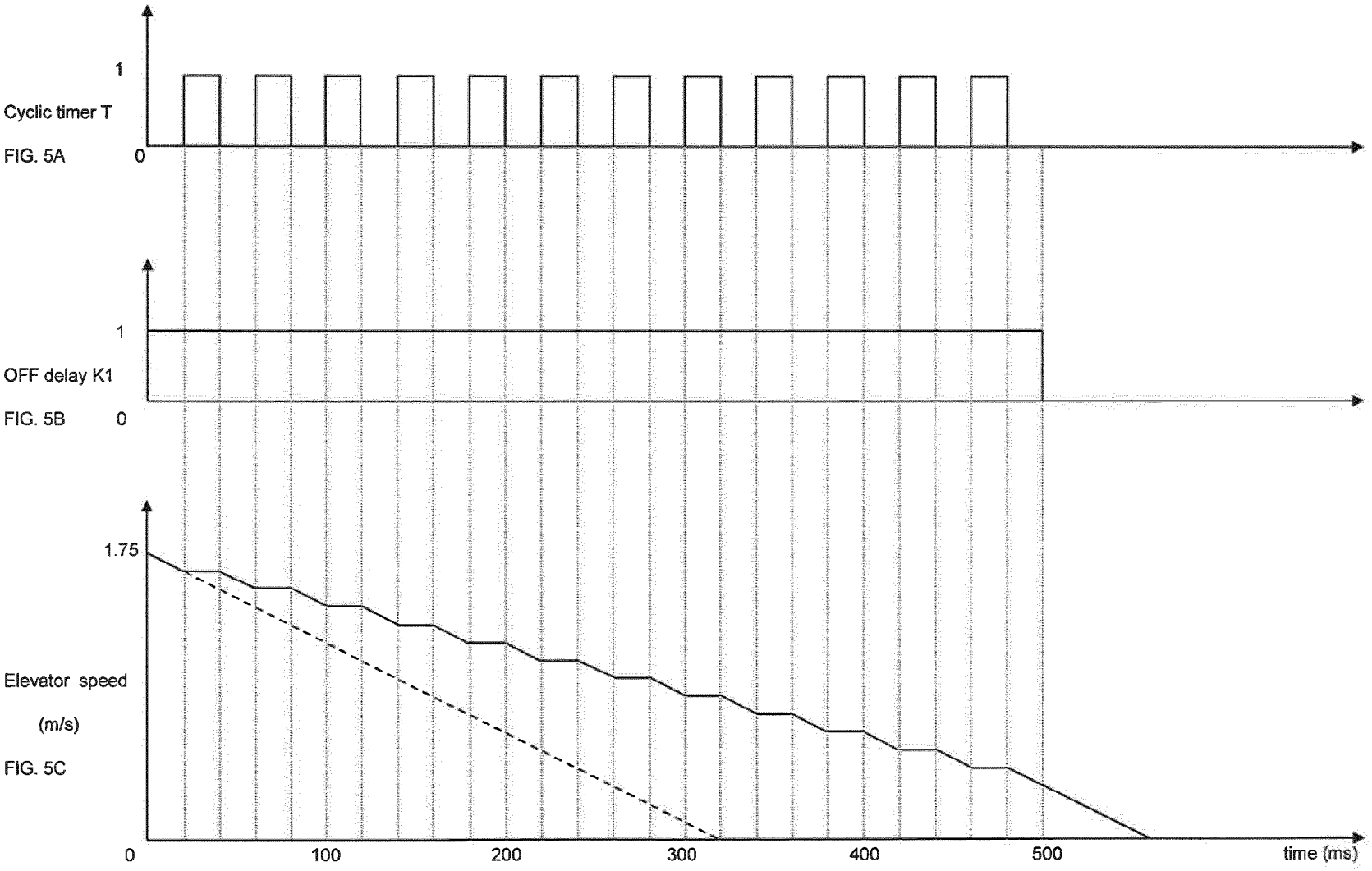
FIG. 5A is a graphical representation of output of the cyclical timer incorporated in the brake control circuit of FIG. 4.
FIG. 5B is a graphical representation of output of the off delay timer K1 incorporated in the brake control circuit of FIG. 4.
FIG. 5C is a graphical representation of the resultant motion of the elevator during power disruption.

As shown in FIG. 5A, the output from the cyclical timer T pulses on for 20 ms and off for 20 ms and continues this cycle thereby causing its power contact T1 in the power circuit 50 to repeatedly open and close the power circuit 50 to the brake coil 34 resulting in the repeated engagement and release the brake 14;16 to slow down the elevator 1 as illustrated in FIG. 5C. Naturally, it will be appreciated that the pulse duration can be adjusted so as to take into account the different rated loads, rated speeds etc. of different elevator installations 1.

In comparison to the conventional braking during power disruption as shown by the dashed line in FIG. 5C, the periodic or staggered braking provided by the present system greatly extends the time taken to bring the elevator to a halt. Accordingly, passengers will feel less discomfort when the elevator is braked automatically during power disruption.

Figure 4:
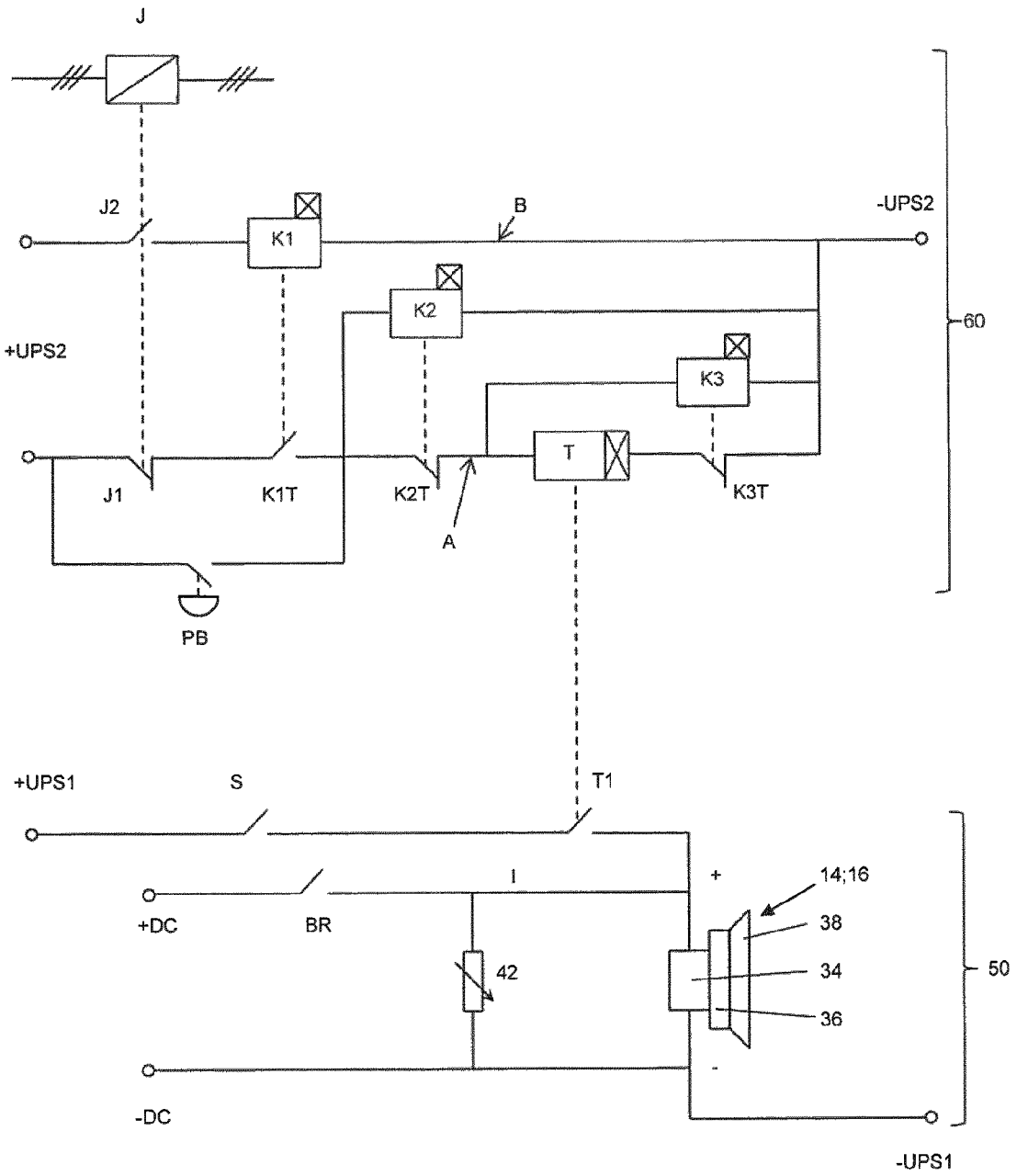
FIG. 4 is an alternative topography of a brake control circuit and a power circuit for use in the brake controller of FIGS. 1 and 2.

FIG. 4 illustrates the topography of a further, more advanced and preferred embodiment of a brake controller 40 according to the present invention.

As in the previously described example, in normal operation of the elevator 1, when sufficient mains power supply is available, DC power derived from the mains power supply, can be selectively supplied to the coil 34 through the brake contactor or relay BR as shown in the power supply circuit 50 towards the bottom of FIG. 4. Accordingly, in normal operation, the brake 14;16 will be released by closing the brake relay BR such that current I flows from the positive terminal +DC through the coil 34 to the negative terminal −DC of the power supply circuit 50. Conversely, when the brake relay BR is opened, the brake coil 34 is simultaneously disconnected from the power supply circuit 50 and the compression springs 32 will move the armature 36 so that the brake lining 38 engages and thereby brakes the brake disc 28.

As before, the power supply circuit 50 additionally contains a further circuit arranged in parallel with the brake coil 34. However, in addition to the cyclical timer power contact T1 and the brake coil 34, this circuit further includes a drive contact S serially arranged with the cyclical timer power contact T1 and the brake coil 34 between the positive and negative terminals of the first uninterruptible power supply UPS1. The drive contact S is closed only whenever the elevator 1 is travelling and open when the elevator is stationary for example when the car 4 is at a landing to allow passengers to enter or exit or when no calls have been made to the elevator controller EC and the elevator 1 is in a stand-by or sleep mode.

The control circuit 60 of this embodiment essentially comprises two parallel branches A and B between the positive terminal +UPS2 and the negative terminal −UPS2 of the second of the uninterruptible power supply.

The lower branch as shown in FIG. 4, branch A, consists of a serial arrangement of the first, normally closed (NC) detection contact J1, a first delay contact K1T (NO), a second delay contact K2T (NC), the cyclical timer T and a third delay contact K3T (NC). The second and third delay contacts K2T and K3T are controlled by second and third timer relays K2 and K3 (ON delay) arranged in parallel with the cyclical timer T. Furthermore, an emergency stop, push button contact PB is arranged in parallel over the first detection contact J1 and the first delay contact K1T.

A second, normally open (NO) detection contact J2 is arranged in series with a first timer relay K1 (OFF delay) in branch B, the upper branch as shown in FIG. 4.

On power failure, the detection relay J within the control circuit 60 de-energizes causing its first contact J1 to close and its second contact J2 to open. The opening of the upper branch B, by the second contact J2 causes first OFF delay timer relay K1 to drop. However, its contact KIT in the lower branch B continues to remain closed for a predetermined interval ΔT equal to or slightly more than the duration expected for the elevator car 4 to come to full halt, say in this instance for 500 ms.

Accordingly, power can now flow through the all contacts on the lower branch A to energize the cyclical timer T.

As shown in FIG. 5A, the output from the cyclical timer T pulses on and off every 20 ms which causes its power contact T1 in the power circuit 50 to repeatedly open and close the power circuit 50 to the brake coil 34. Accordingly, the brake 14;16 is repeatedly engaged and released to slow the down the elevator as illustrated in FIG. 5C. After the preset OFF delay interval ΔT for first delay timer relay K1 has elapsed, in this instance 500 ms, its contact KIT in the lower branch B of the control circuit 60 will open, as illustrated in FIG. 5B, and thereby prevent further power to flow to the cyclical timer T. At this point the full braking will be applied as in a conventional system.

In comparison to the conventional braking during power disruption as shown by the dashed line in FIG. 5C, the periodic or staggered braking provided by the present system greatly extends the time taken to bring the elevator to a halt. Accordingly, passengers will feel less discomfort when the elevator is braked automatically during power disruption.

The control circuit 60 of FIG. 4 has been designed specifically for fail-safe operation in that if the first delay timer relay K1 fails, then the second delay timer relay K2 (1000 ms ON delay) which has a larger preset ON delay interval will operate its contact K2T to de-energize the cyclical timer T in branch A. Similarly, in the unlikely event that the second delay timer K2 also fails, then the third delay timer relay K3 which has again a longer preset ON delay interval, namely 1500 ms, will operate its contact K3T to de-energize the cyclical timer T. This three level safety interlock of delay timer relays K1, K2, K3 ensures that the brake coil 34 will not be supplied with power after a preset period.

It will be appreciated that the delay timer relays and their respective contacts can be effectively arranged and organized in a different manner to achieve the same objective, namely, to de-energize the cyclical timer T after the predetermined delay interval. For example, delay timer relay K3 could have the shortest delay interval. In fact all of the delay timer relays could have the same predetermined delay interval which for a particular elevator installation 1 could be set to equate to the duration expected for the brake 14;16 to bring the elevator car 4 to a full halt. This of course would depend on the rated load and rated speed of the specific elevator 1.

The use of one or more delay timer relays in the above embodiment is to ensure that the cyclical timer T operates only when needed to bring the moving elevator 1 to a halt rather than for the entire duration of the power disruption which could in certain instances be several hours. This effectively limits the power capacity required of and the power drawn from the first uninterruptible power supply UPS1 during disruption of commercial mains power. For example, in the embodiment of FIG. 4, the first uninterruptible power supply UPS1 need only intermittently supply power to the brake coil 34 for a 500 ms period, assuming that the first delay timer relay K1 operates after its predetermined delay interval ΔT.

Additionally, in the power supply circuit 50 of FIG. 4, the cyclical timer contact T1 is connected in series with the drive contact S. This ensures that the control circuit 60 is completely isolated from the electromagnetic brake 14:16 during normal operation when mains power supply is available. Furthermore, as explained above, the drive contact S is closed only whenever the elevator 1 is travelling. Accordingly, the first uninterruptible power supply UPS1 only needs to supply energy to the brake coil 34 when the elevator 1 is travelling upon commencement of the disruption to the commercial power supply.

On the contrary if the elevator 1 is already stationary upon commencement of mains power supply disruption, whereby the compression springs 32 will already have biased the armature 36 such that the brake lining 38 is engaged with and holds the brake disc 28 stationary, then there is no need for further braking and the open drive contact S will prevent energy to follow from the first uninterruptible power supply UPS1 to the brake coil 34.

Although the invention has been described above for use in the situation where a disruption to the commercial mains power supply has occurred, the brake controller 40 is equally beneficial in an emergency stop situation to bring the travelling elevator 1 to a halt more smoothly. If for example a passenger within the elevator car 4 presses, for whatever reason, the emergency stop button within the car 4, in a conventional elevator the brakes would immediately be engaged to bring the elevator 1 to an abrupt halt as shown by the dashed line in FIG. 5C. In the embodiment illustrated in FIG. 4, such passenger activation of the emergency stop button in the car would close the emergency stop, push button contact PB arranged in parallel over the first detection contact J1 and the first delay contact KIT of the lower branch A of the brake control circuit 60. Accordingly, power would flow through the cyclical timer T and the output from the cyclical timer T pulses on and off every 20 ms causing its power contact T1 in the power circuit 50 to repeatedly open and close the power circuit 50 to the brake coil 34. Accordingly, the brake 14;16 is repeatedly engaged and released to slow the down the elevator more smoothly as illustrated in FIG. 5C.

The or each uninterruptible power supply UPS as used in the examples described above can be a simple battery arrangement with or without battery charging capability from the mains power supply. Alternatively, it may be any suitable electrical storage system that can continue to supply electricity during a mains power disruption for a small amount of time. For example, it could be a simple capacitor bank capable of supplying brief intermittent power for about 1-2 seconds which, as illustrated in FIG. 5C, is all that is the time that is needed to ensure the brake 14,16 has brought the moving elevator 1 to a complete stop.

Furthermore, it should be noted that the optional components of the elevator brake controller 40 as illustrated FIG. 4 can also be implemented on the brake controller 40 embodiment of FIG. 3. For example, the ON delay timer relay K3 of FIG. 4 can be arranged in parallel to the cyclical timer T of FIG. 3 with its delay contact K3T arranged in series with the cyclical timer T. In doing so, the cyclical timer T will not be operational for the complete duration of a power disruption but only for the duration of the predetermined delay interval preset in the delay timer relay K3.

Additionally, the embodiment illustrated in FIG. 3 can be provided with the emergency contact PB of FIG. 4 such that passenger activation of the emergency stop button in the car would close the emergency stop, push button contact PB arranged in parallel over the first detection contact J1 of the lower branch A of the brake control circuit 60. Accordingly, power would flow through the cyclical timer T and the output from the cyclical timer T pulses on and off every 20 ms causing its power contact T1 in the power circuit 50 to repeatedly open and close the power circuit 50 to the brake coil 34. Accordingly, the brake 14;16 is repeatedly engaged and released to slow the down the elevator more smoothly as illustrated in FIG. 5C.

Figure 6:
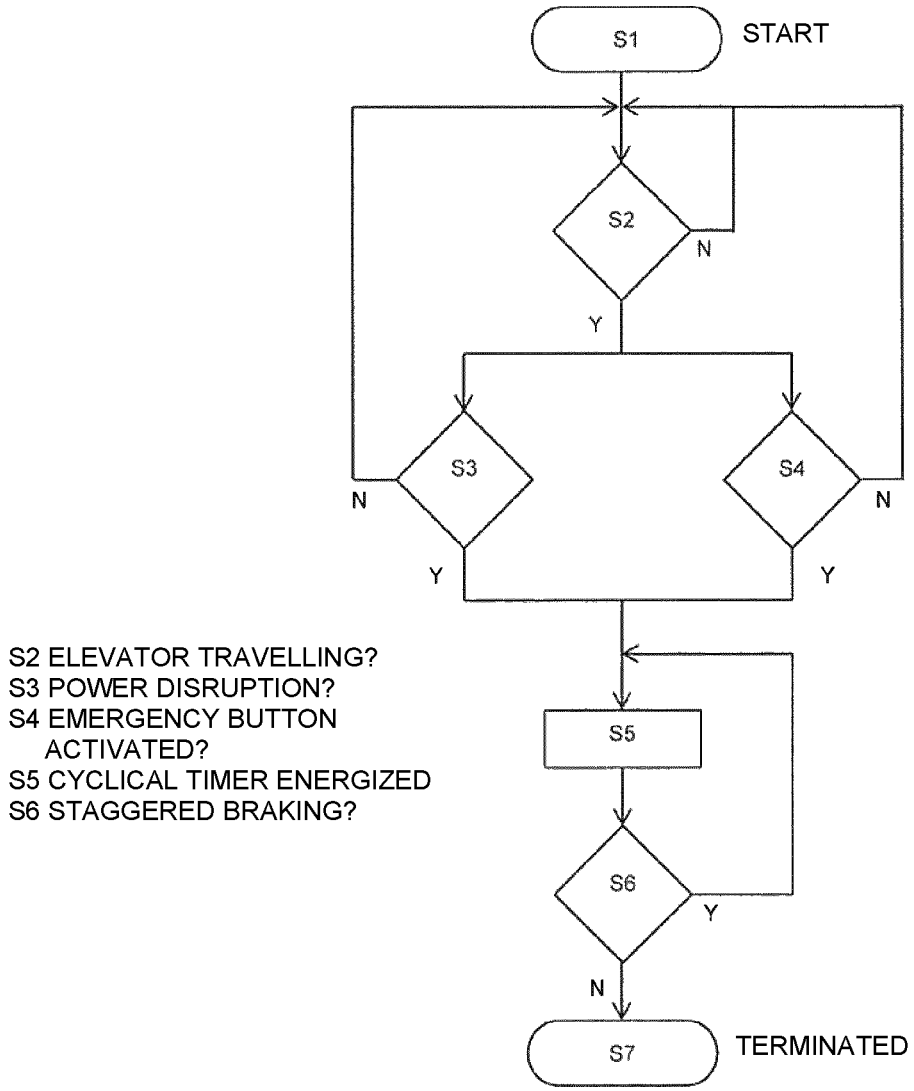
FIG. 6 is a flowchart illustrating a method of operating an electromagnetic elevator brake in accordance with the present invention.

The method of operating an electromagnetic elevator brake 14;16 in accordance with the present invention is represented in the flowchart of FIG. 6. This particular method has been adopted to use all of the options available within the brake controller 40 of FIG. 4 but it will be easily recognizable that a simplified method can be used in relation to the brake controller 40 illustrated in FIG. 3.

The procedure starts at step S1 when the elevator 1 running in normal operation mode when sufficient mains power supply is available and when the emergency stop button or switch within the elevator car 4 has not been at activated.

In step S2 it is determined whether the elevator 1 is travelling. This determination can be made from the state of the drive contact S which, as explained above, is closed only whenever the elevator 1 is travelling and open when the elevator stationary in all other instances for example when the car 4 is at a landing to allow passengers to enter or exit or when no calls have been made to the elevator controller EC and the elevator 1 is in a stand-by or sleep mode. Naturally, if the elevator 1 is not travelling then there is no need to brake the elevator 1 and accordingly the procedure loops back upon itself.

If, however, the elevator 1 is travelling, indicated by the closed drive contact S, then the procedure goes on to two subsequent parallel steps S3 and S4.

In the first of these, step S3, the method determines whether there has been a disruption to the commercial mains power supply. As previously described, this determination can be made by the detection relay J. If no power failure or disruption is detected, the procedure loops back to step S2.

In the second of these parallel steps, step S4, a determination is made as to whether the emergency button or switch has been activated by a passenger within the elevator car 4. As in step S3, if the determination is negative then the procedure loops back to step S2.

If either of the decisions made in step S3 or step S4 is positive, indicating that there is either a power failure or that the emergency stop button has been pressed, then the procedure proceeds to step S5 where the cyclical timer T in the control circuit 60 is energized resulting in pulsed braking as illustrated in, and described above with respect to, FIG. 5C. The cyclical timer T may be energized either due to the dropping of the detection relay J in step S3 or by the closing of the push button contact PB in step S4.

Step S6 is indicative of the time-dependent reiterative nature of the pulsed braking. In the embodiment of FIG. 4 it is implemented by the first delay timer relay K1 in branch B of the control circuit 60. If the time since the commencement of the pulsed braking is less than the preset delay interval ΔT of the first delay timer relay K1 (i.e. 500 ms), then its delay contact KIT continues to remain closed on lower branch A of the brake control circuit 60 and the cyclical timer T continues to be energized by the second uninterruptible power supply UPS2. In the flowchart this is indicated by the loop back to step S5.

If, however, the time since the commencement of the pulsed braking is not less than the preset delay interval ΔT of the first delay timer relay K1, resulting in a negative decision in step S6, then the procedure is terminated in step S7 when the delay contact KIT in the lower branch B of the control circuit 60 opens, as illustrated in FIG. 5B, and thereby prevents further power to flow to the cyclical timer T. At this point full braking will be applied as in a conventional system as illustrated in FIG. 5C.

Naturally, the person skilled in the art will easily appreciate that the method steps can be changed; e.g., the step of determining whether the elevator 1 is travelling S2 can be made after the parallel steps S3 and S4.

For the embodiment of the brake controller 40 depicted in FIG. 3 the procedure outlined above can be simplified by removing steps S2, S4 and S6.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An apparatus for operating an electromagnetic elevator brake comprising:

a power circuit connected in parallel to a brake coil of the elevator brake, the power circuit including a first uninterruptible power supply and a power contact to open and close the power circuit; and a control circuit having a serial branch including a cyclical timer and a detection contact connected in series across a second uninterruptible power supply, wherein the cyclical timer, upon energization, repeatedly opens and closes the power contact to generate staggered braking of the elevator brake.

2. The apparatus according to claim 1 wherein the detection contact is responsive to a disruption of mains power to the elevator brake.

3. The apparatus according to claim 1 wherein the detection contact is responsive to a pressing of an emergency stop button within an elevator car braked by the elevator brake.

4. The apparatus according to claim 1 wherein the detection contact is a first detection contact and including a second detection contact connected in parallel across the first detection contact.

5. The apparatus according to claim 1 wherein the control circuit includes at least one delay timer relay connected in parallel across the cyclical timer.

6. The apparatus according to claim 5 wherein the at least one delay timer relay operates a delay contact in the serial branch.

7. The apparatus according to claim 1 wherein the detection contact is responsive to a disruption of mains power to the elevator brake and including a detection relay detecting the disruption of mains power and operating the detection contact.

8. The apparatus according to claim 7 wherein the serial branch is a first serial branch, the control circuit having a second serial branch including a delay timer relay and a further detection contact connected across the second uninterruptible power supply, the further detection contact being operable by the detection rely.

9. The apparatus according to claim 1 wherein the power circuit includes a drive contact serially connected to the power contact and the brake coil.

10. The apparatus according to claim 1 wherein the first uninterruptible power supply and the second uninterruptible power supply are a single uninterruptible power supply feeding power to the power circuit and to the control circuit.

11. The apparatus according to claim 1 wherein the control circuit is implemented in software run by the apparatus.

12. A method of operating an electromagnetic elevator brake comprising the steps of:

providing a power circuit connected in parallel to a brake coil of the elevator brake, the power circuit including an uninterruptible power supply and a power contact to open and close the power circuit; and providing a control circuit having a serial branch including a cyclical timer and a detection contact connected in series across the uninterruptible power supply, wherein the cyclical timer, upon energization, repeatedly opens and closes the power contact to generate staggered braking of the elevator brake;

determining whether there is a disruption to a commercial mains power supply providing power to the elevator brake or whether an emergency button has been activated in an elevator car braked by the elevator brake; and repeatedly opening and closing the power circuit to generate staggered braking of the elevator car.

13. The method according to claim 12 including a step of determining whether the elevator car is travelling.

14. The method according to claim 12 wherein the step of repeatedly opening and closing the power circuit is performed for a preset interval of time.

15. The method according to claim 12 including terminating the step of repeatedly opening and closing the power circuit by maintaining the power circuit open.

* * * * *